US006854776B2

(12) United States Patent
Downing

(10) Patent No.: US 6,854,776 B2
(45) Date of Patent: Feb. 15, 2005

(54) ARCHERY ARROW SHAFT GRIPPER AND PULLER

(76) Inventor: Dennis A. Downing, Rt. 1 Box 1093 Pioneer Rd., Homedale, ID (US) 83628

( * ) Notice: Subject to any disclaimer, the term of this patent is extended or adjusted under 35 U.S.C. 154(b) by 0 days.

(21) Appl. No.: 10/266,492

(22) Filed: Oct. 8, 2002

(65) Prior Publication Data

US 2004/0066050 A1 Apr. 8, 2004

(51) Int. Cl.[7] ..... B25B 9/00
(52) U.S. Cl. ..... 294/1.1; 294/16; 254/131
(58) Field of Search ..... 294/1.1, 8.5, 11, 294/16, 28, 50.8, 99.2, 106, 118; 254/22, 23, 122, 130, 131; 29/267, 268; 124/23.1

(56) References Cited

U.S. PATENT DOCUMENTS 2,610,081 A * 9/1952 Bushman ..... 294/28
3,119,597 A * 1/1964 Stephens ..... 254/29 R
3,318,177 A * 5/1967 Crump ..... 81/300
3,826,471 A * 7/1974 Orton et al. ..... 254/131
3,873,068 A * 3/1975 Allen ..... 254/131
3,890,692 A * 6/1975 Jandura ..... 29/426.5
5,102,100 A 4/1992 Troncoso
5,445,424 A * 8/1995 Binette ..... 294/1.1
5,544,926 A 8/1996 Ravencroft
5,546,621 A * 8/1996 Bulot ..... 7/138
5,991,997 A * 11/1999 Schley et al. ..... 29/426.5

* cited by examiner

*Primary Examiner*—Dean J. Kramer
(74) *Attorney, Agent, or Firm*—Charles R. Clark

(57) ABSTRACT

A novel apparatus for gripping and pulling an archery arrow shaft without damage to the arrow from a target or other object in which the arrow is partially embedded. The apparatus uses gripping pads and levers to grip and to pull the shaft of the arrow from the target or other object.

11 Claims, 5 Drawing Sheets

ARCHERY ARROW SHAFT GRIPPER AND PULLER

CROSS-REFERENCE TO RELATED APPLICATIONS

Not applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

When modern archery arrows and targets are used in target shooting by an archer, the arrows often are partially embedded in a target so securely as to be not removable from the target without the aid of a tool or an apparatus to assist the archer in a gripping and a pulling of such arrows.

The present invention relates to a novel apparatus for the gripping and the pulling of an archery arrow from targets or objects in which the arrow is partially and securely embedded without causing damage by the apparatus to the arrow.

A number of pulling devices exist that can aid an archer in withdrawing an arrow from an object in which the arrow is partially embedded. Archers are known to use sheets of rubber-like material to improve the grip of their fingers around the shaft of an arrow that is to be pulled by hand from a target. In U.S. Pat. No. 5,544,926 issued to Ravencroft is disclosed a shaft gripper for use in pulling an arrow.

BRIEF SUMMARY OF THE INVENTION

A principal objective of this invention is to provide an archer with a novel archery arrow shaft gripper and puller that uses two linked handles mounted with resilient gripping pads first to grip an arrow shaft of an arrow and then to pull the arrow from a target or an object without damage to the arrow. The handles function as levers to increase the archer's gripping power. The handles may also function as a lever about a fulcrum base to increase the archer's pulling power. The invention also provides greater safety to the archer by allowing improved control of the gripping and the pulling processes.

A further object of the invention is to provide an archery arrow shaft gripper and puller that effectively deals with a situation where two or more arrows are grouped in a target with their respective shafts closely adjacent or even contacting one another. The invention provides useful means to grip and to pull one arrow at a time from a group of two or more arrows.

A further object of the invention is to provide an archery arrow shaft gripper and puller that effectively deals with a situation where only an arrow shaft is accessible to be gripped.

Additional and various other objects and advantages attained by the invention will become more apparent as the specification is read and the accompanying figures are reviewed.

DETAILED DESCRIPTION OF THE INVENTION

Figure 1:
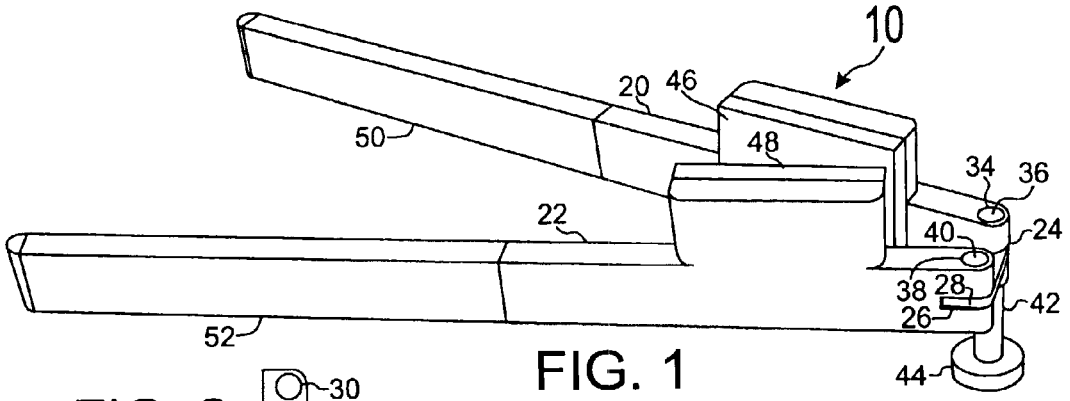
FIG. 1 is a perspective view of an archery arrow shaft gripper and puller.

Referring to FIG. 1, the present invention is novel and provides an archery arrow shaft gripper and puller 10 for gripping an arrow shaft of an arrow and pulling the arrow from a target or other object.

The archery arrow shaft gripper and puller 10 comprises a left handle 20 and a right handle 22 each having a hinged end and an open end. The hinged end of the left handle 20 is hinged by a connecting means to the hinged end of the right handle 22. The handles 20 and 22 face each other. The connecting means allows the handles 20 and 22 to swing towards and away from each other in a single plane.

In the preferred embodiment, the connecting means comprises a left horizontal receiving slot 24 in the hinged end of the left handle 20, a right horizontal receiving slot 26 in the hinged end of the right handle 22, a horizontal linking bridge 28 slidingly received in the slots, the bridge having two vertical bridge bores 30 and 32, a left vertical pin bore 34 in the left handle intersecting the left horizontal receiving slot and coaxial with bridge bore 30, a fulcrum pin 36 retained in said left vertical pin bore and slidingly received through said bridge bore 30, a right vertical pin bore 38 in the right handle intersecting the right horizontal receiving slot and coaxial with bridge bore 32, and a right retaining pin 40 retained in said right vertical pin bore and slidingly received through said bridge bore 32.

Figure 2:
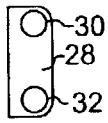
FIG. 2 is a top plan view of a linking bridge of the archery arrow shaft gripper and puller.
Figure 3:
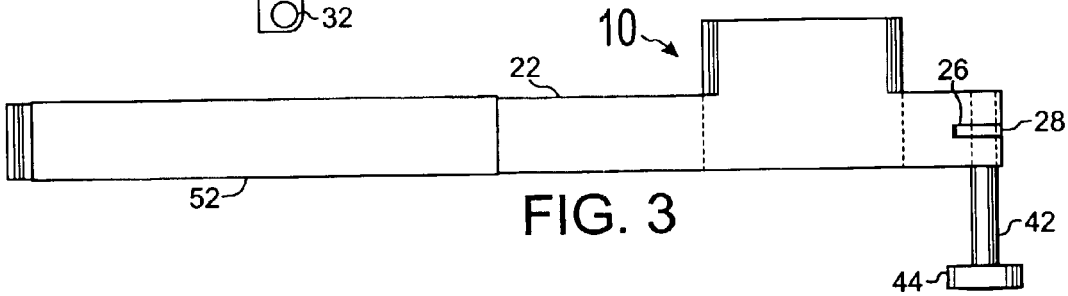
FIG. 3 is a side elevational view of the archery arrow shaft gripper and puller.
Figure 4:
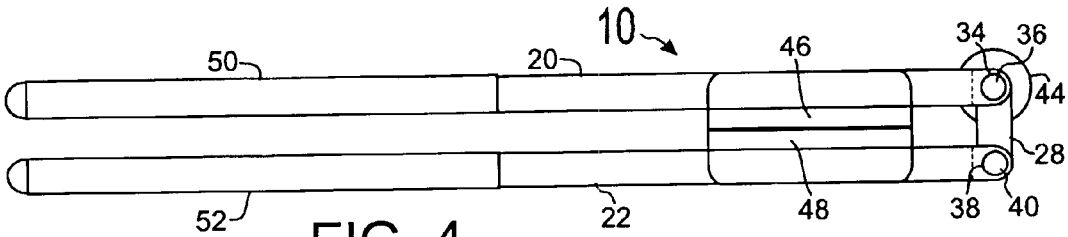
FIG. 4 is a top plan view of the archery arrow shaft gripper and puller.

The linking bridge 28 has a first vertical bridge bore 30 at a first end of the bridge and a second vertical bridge bore 32 at a second end of the bridge as shown in FIG. 2. The bridge bores 30 and 32 are spaced, parallel, and vertical. The first end of the horizontal linking bridge 28 is slidingly received into the left horizontal receiving slot 24, the first vertical bridge bore 30 is coaxially aligned with the left vertical pin bore 34, and the bridge is retained in the left horizontal receiving slot by a fulcrum pin 36 that is closely fitted and retained in the left vertical pin bore and that is slidingly received through the first vertical bridge bore 30. The second end of the horizontal linking bridge 28 is slidingly received into the right horizontal receiving slot 26, the second vertical bridge bore 32 is coaxially aligned with the right vertical pin bore 38, and the bridge is retained in the right horizontal receiving slot by a right retaining pin 40 that is closely fitted and retained in the right vertical pin bore and that is slidingly received through the second vertical bridge bore 32.

The bridge 28 is retained in the slots 24 and 26 by the pins 36 and 40, is gapped from the full depths of the slots, and is free to pivot about the pins as confined by the slots to a single plane. The pins 36 and 40 can be alternatively replaced by appropriate nuts and bolts or rivets.

Preferably, the fulcrum pin 36 has an extending fulcrum shaft 42 that is of greater diameter than the portion of the fulcrum pin that is inserted into and retained in the left vertical pin bore 34. The extending fulcrum shaft 42 extends out and down from the left vertical pin bore 34 of the left handle 20. Preferably, the extending fulcrum shaft 42 has a large fulcrum base 44 at its end away from the left handle 20 as shown in FIGS. 1 through 8.

The left handle 20 has a gripping pad 46 and the right handle 22 has a gripping pad 48 with each gripping pad mounted to its respective handle near the hinged end of the handle and with the gripping pads mounted facing each other in a cooperating relationship when the handles are swung towards one another. The gripping pads 46 and 48 preferably are resilient; have nonslip surfaces; are fabricated from neoprene, natural gum rubber, or other suitable elastomeric material; and are mounted to the handles 20 and 22 by means of a suitable adhesive or glue. When the puller 10 grips a shaft of an arrow that is to be pulled from a target or an object, the pads 46 and 48 cooperate and grip opposite sides of the shaft and cushion the gripping action of the puller on the shaft.

Preferably, the handles 20 and 22 each have a cushioning hand grip 50 or 52 mounted towards the open end of each respective handle and away from the respective pads 46 and 48. The hand grips 50 and 52 can be slip-on rubber or synthetic rubber tubes and provide cushioning to a user's hand when the handles 20 and 22 are gripped by the hand or hands of a user and when the handles are squeezed together.

Preferably, the handles 20 and 22 and the bridge 28 are fabricated from aluminum, stainless steel, plastic, or another suitable material or metal or alloy. The pins 36 and 40 can be fabricated from cold rolled steel, aluminum, stainless steel, plastic, or another suitable material or metal or alloy. Preferably, the handles 20 and 22 each have a generally rectangular cross-section.

Figure 5:
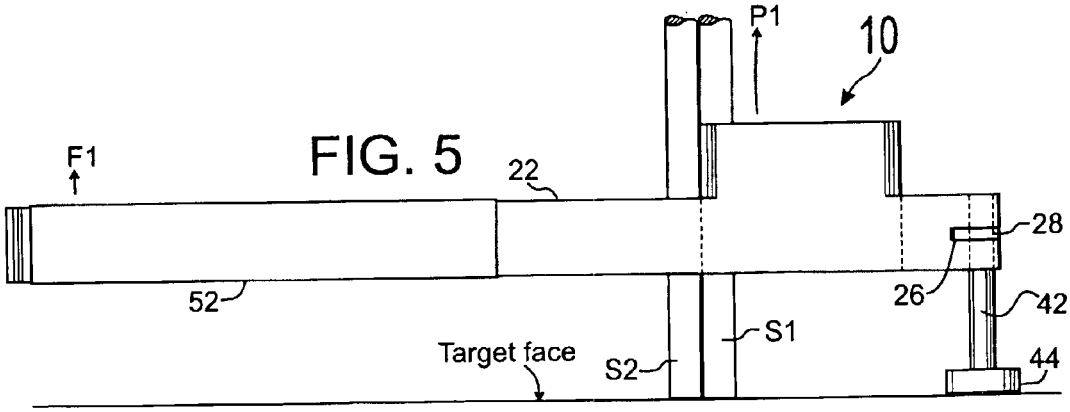
FIG. 5 is a side elevational view of the archery arrow shaft gripper and puller showing the puller gripping a shaft S1 of an arrow partially embedded in a target alongside another shaft S2.
Figure 6:
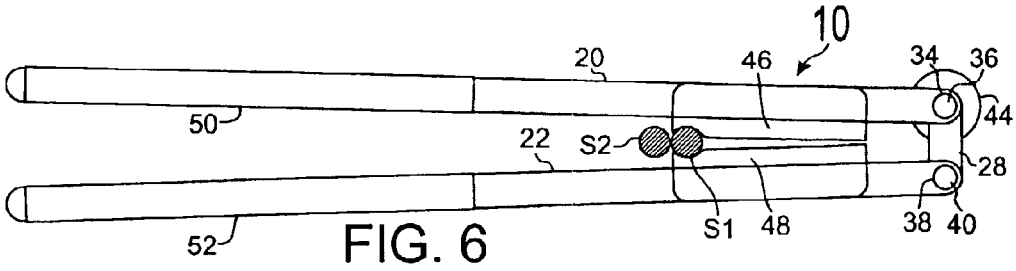
FIG. 6 is a top plan view of the archery arrow shaft gripper and puller showing the puller gripping the shaft S1 shown in FIG. 5.

Preferably, in practice, the puller 10 is used in one or another of two preferred methods to pull an arrow from a target or an object in which the arrow is partially embedded. A first method uses the puller 10 as best shown in FIG. 5 to pull an arrow having a shaft S1 from a target. The shaft S1 in FIG. 5 is adjacent and alongside another arrow shaft S2. The handles 20 and 22 are arranged around the shaft S1 of an arrow to be pulled with two cooperating facing portions of the gripping pads 46 and 48 brought into contact with opposite sides of the shaft S1 of the arrow and with the fulcrum base 44 resting against a portion of the target face or the object face. The handles 20 and 22 are then squeezed together towards one another to grip the shaft S1 and then while being squeezed together, the open ends of the two handles are briskly pulled away from the target face a short distance in a user controlled manner to apply a force F1 that is multiplied into a greater pulling force P1 along the arrow indicated in FIG. 5. With small pulling movements of the handles away from the target face, the pulling force P1 is generally parallel to the longitudinal axis of the shaft S1. This method of use is particularly effective to initiate movement of the shaft S1 of an arrow that is tightly embedded in a target. After initial movement of the shaft S1 out of the target, the handles 20 and 22 can be spread and the pads 46 and 48 can be repositioned along the shaft towards the target face for another pulling cycle and another small movement of the shaft out of the target.

Figure 7:
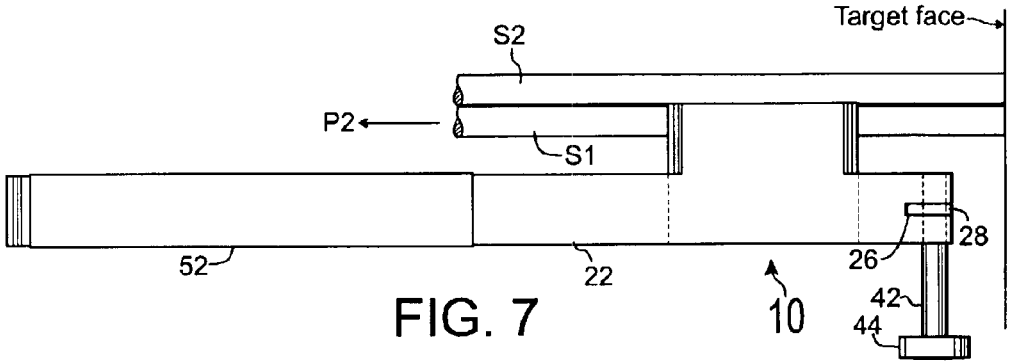
FIG. 7 is a side elevational view of the archery arrow shaft gripper and puller showing an alternative gripping relationship between the puller and the shaft S1 of an arrow partially embedded in a target alongside another arrow shaft S2.
Figure 8:
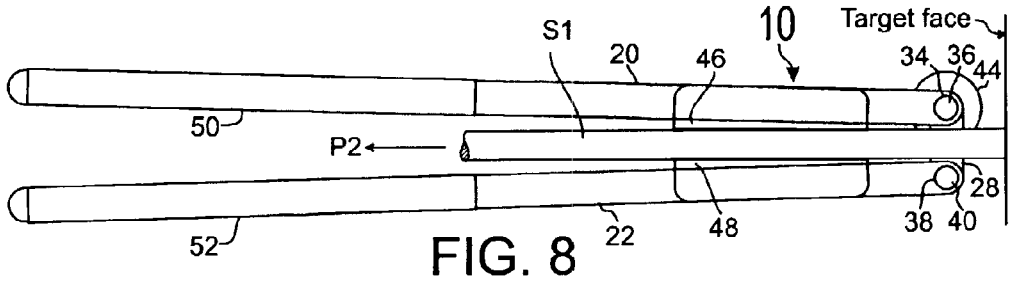
FIG. 8 is a top plan view of the archery arrow shaft gripper and puller showing the puller gripping the shaft S1 shown in FIG. 7 with the shaft S2 not shown.

A second method uses the puller 10 as shown in FIGS. 7 and 8 to grip a shaft S1 of an arrow and allows the user then to apply a non-leveraged pulling force P2 directly parallel to and along the longitudinal axis of the shaft and away from the target face or object face.

The design of the puller 10 permits the user to choose what cooperating facing portions of the pads 46 and 48 will be used to grip the shaft S1. The puller 10 allows application of effective pulling force generally along the longitudinal axis of the shaft of an arrow even for arrows that are lodged closely adjacent to one or more other arrows in a target or an object.

Figure 9:
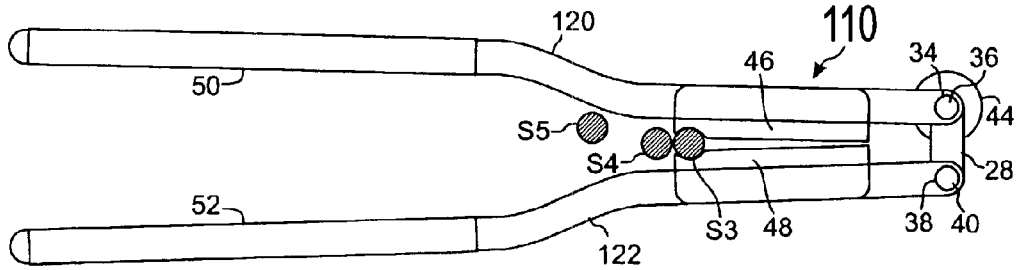
FIG. 9 is a top plan view of a first alternative embodiment of the archery arrow shaft gripper and puller showing the puller gripping a shaft S3 from a group of three shafts S3, S4, and S5.

In a first alternative archery arrow shaft gripper and puller 110 as shown in FIG. 9, alternative handles 120 and 122 are substituted in place of the handles 20 and 22 of the puller 10 (the preferred embodiment). The handles 120 and 122 are shaped to provide additional working space between the handles over the smaller working space provided between the handles 20 and 22 of puller 10.

Figure 10:
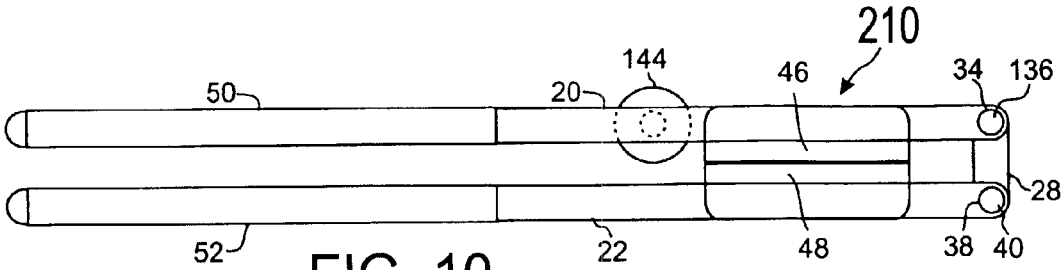
FIG. 10 is a top plan view of a second alternative embodiment of the archery arrow shaft gripper and puller.
Figure 11:
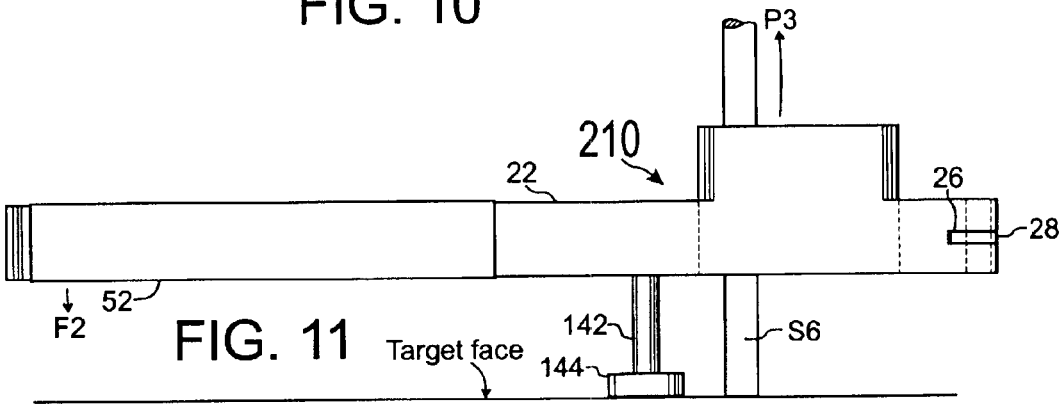
FIG. 11 is a side elevational view of the archery arrow shaft gripper and puller shown in FIG. 10 showing the puller gripping a shaft S6 of an arrow partially embedded in a target.

In a second alternative archery arrow shaft gripper and puller 210 as shown in FIGS. 10 and 11, the puller 10 is modified by the replacement of the fulcrum pin 36 with a left retaining pin 136 in the left vertical pin bore 34 and an alternative extending fulcrum shaft 142 (shown in FIG. 11) is mounted to a lower side of left handle 20 near its gripping pad 46 and located along the handle between the gripping pad and the open end of the handle. Preferably, the alternative extending fulcrum shaft 142 has a large fulcrum base 144 at its end away from the left handle 20 as shown in FIG. 11.

In puller 210, the fulcrum pin 36 of puller 10 can serve as the alternative extending fulcrum shaft 142 and the fulcrum base 144 by being mounted in a transverse bore that is parallel to and spaced from the left vertical pin bore 34 of the left handle 20 and located near its gripping pad 46 and along the handle between the gripping pad and the open end of the handle.

As shown in FIG. 11, in a third method of use, the puller 210 grips a shaft S6 with the fulcrum base 144 resting against a portion of the target face and then the open ends of the two handles 20 and 22 are briskly pushed toward the target face a short distance in a user controlled manner to apply a force F2 that is multiplied by lever action into a greater pulling force P3 along the arrow indicated in FIG. 11. With small pushing movements of the open ends of the handles 20 and 22 toward the target face, the pulling force P3 is generally parallel to the longitudinal axis of the shaft S6.

Figure 12:
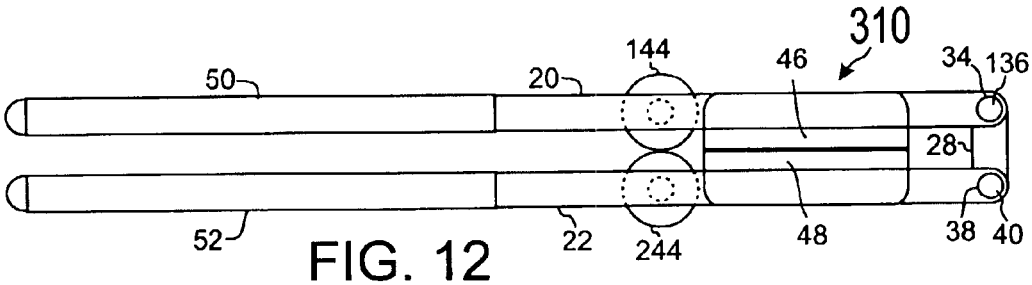
FIG. 12 is a top plan view of a third alternative embodiment of the archery arrow shaft gripper and puller.
Figure 13:
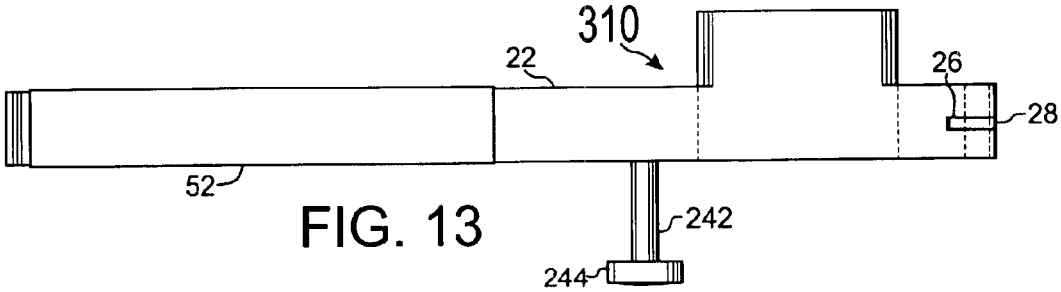
FIG. 13 is a side elevational view of the archery arrow shaft gripper and puller shown in FIG. 12.
Figure 14:
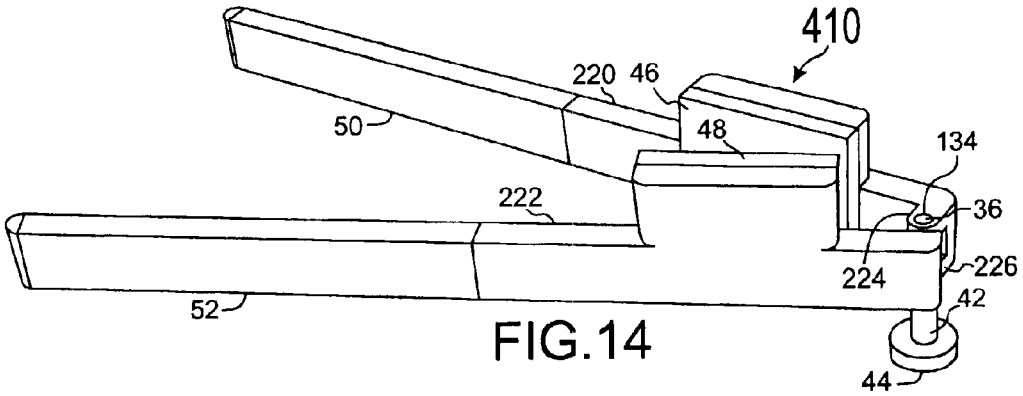
FIG. 14 is a perspective view of a fourth alternative embodiment of the archery arrow shaft gripper and puller.
Figure 15:
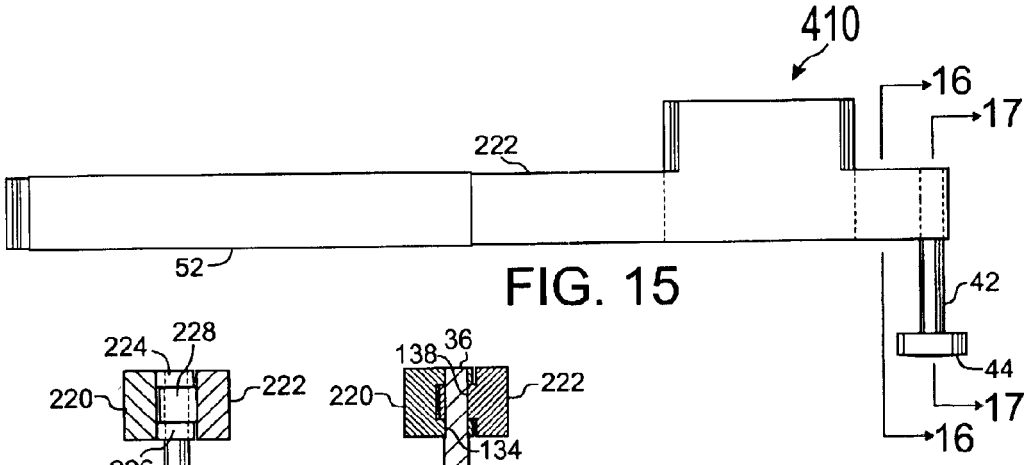
FIG. 15 is a side elevational view of the archery arrow shaft gripper and puller shown in FIG. 14.
Figure 16:
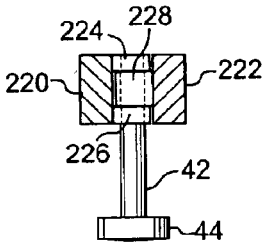
FIG. 16 is a sectional view along line 16—16 shown in FIG. 15.
Figure 17:
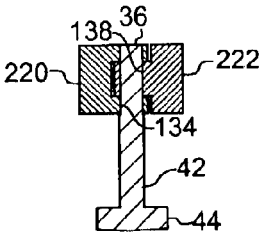
FIG. 17 is a sectional view along line 17—17 shown in FIG. 15.
Figure 18:
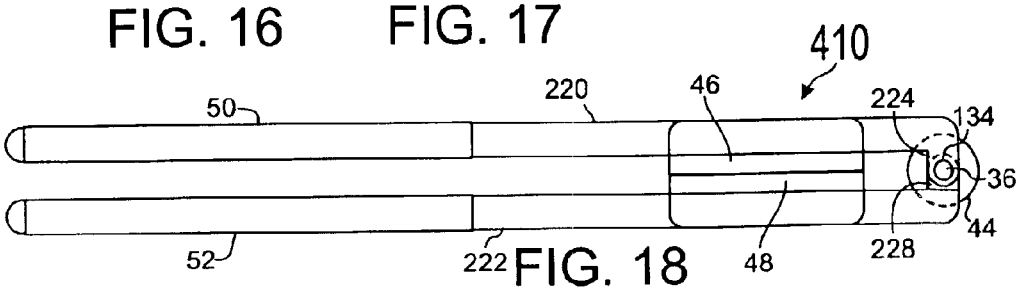
FIG. 18 is a top plan view of the fourth alternative embodiment of the archery arrow shaft gripper and puller shown in FIG. 14.

In a third alternative archery arrow shaft gripper and puller 310 as shown in FIGS. 12 and 13, the puller 210 is modified by the addition of a second extending fulcrum shaft 242 (shown in FIG. 13). The second extending fulcrum shaft 242 is mounted to a lower side of the right handle 22 near its gripping pad 48 and located along the handle between the gripping pad and the open end of the handle. Preferably, the second extending fulcrum shaft 242 has a large fulcrum base 244 at its end away from the right handle 22 as shown in FIG. 13.

In a fourth alternative archery arrow shaft gripper and puller 410 as shown in FIGS. 14, 15, 16, 17, and 18; the connecting means comprises an alternative left handle 220 having preferably two left hinge lugs 224 and 226 at a hinged end of the left handle, an alternative left vertical pin bore 134, an alternative right handle 222 having at least one right hinge lug 228 at a hinged end of the right handle, an alternative right vertical pin bore 138 (shown in FIG. 17), and a fulcrum pin 36. The two left hinge lugs 224 and 226 have an alternative left vertical pin bore 134 through them transverse to the longitudinal axis of the left handle 220 and sized to receive and retain a fulcrum pin 36. The right hinge lug 228 has an alternative right vertical pin bore 138 through it transverse to the longitudinal axis of the right handle 222 and sized to slidingly receive through it the fulcrum pin 36. The right hinge lug 228 is interlaced between the two left hinge lugs 224 and 226, the pin bores 134 and 138 are aligned coaxially, and the fulcrum pin 36 is inserted into the bores from below.

In puller 410, the fulcrum pin 36 has an extending fulcrum shaft 42 that is of greater diameter than the portion of the fulcrum pin that is inserted into and retained in the alternative left vertical pin bore 134. The extending fulcrum shaft 42 extends out and down from the alternative left vertical pin bore 134 of the alternative left handle 220. Preferably, the extending fulcrum shaft 42 has a large fulcrum base 44 at its end away from the left handle 220 as shown in FIGS. 14 through 18.

Figure 19:
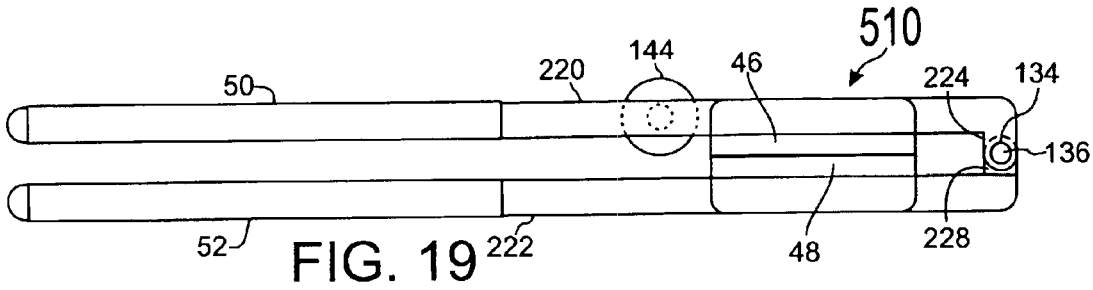
FIG. 19 is a top plan view of a fifth alternative embodiment of the archery arrow shaft gripper and puller.
Figure 20:
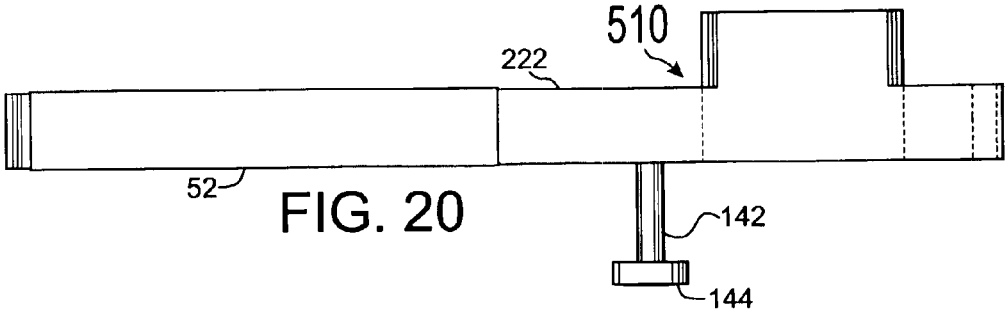
FIG. 20 is a side elevational view of the archery arrow shaft gripper and puller shown in FIG. 19.

In a fifth alternative archery arrow shaft gripper and puller 510, as shown in FIGS. 19 and 20; the puller 410 is modified by the replacement of the fulcrum pin 36 with a left retaining pin 136 in the bores 134 and 138 and an alternative extending fulcrum shaft 142 (shown in FIG. 20) is mounted to a lower side of left handle 220 near its gripping pad 46 and located along the handle between the gripping pad and the open end of the handle. Preferably, the alternative extending fulcrum shaft 142 has a large fulcrum base 144 at its end away from the left handle 220 as shown in FIG. 20.

In puller 510, the fulcrum pin 36 of puller 10 can serve as the alternative extending fulcrum shaft 142 and the fulcrum base 144 by being mounted in a transverse bore that is parallel to and spaced from the alternative left pin bore 134 of the alternative left handle 220 and located near the gripping pad 46 and along the left handle between the gripping pad and the open end of the handle.

Figure 21:
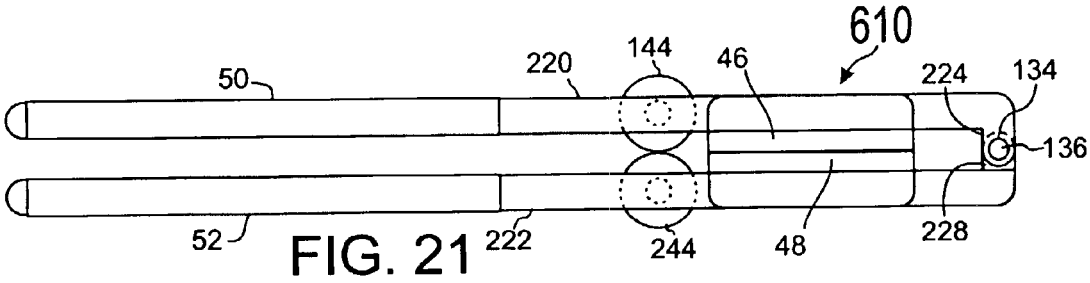
FIG. 21 is a top plan view of a sixth alternative embodiment of the archery arrow shaft gripper and puller.
Figure 22:
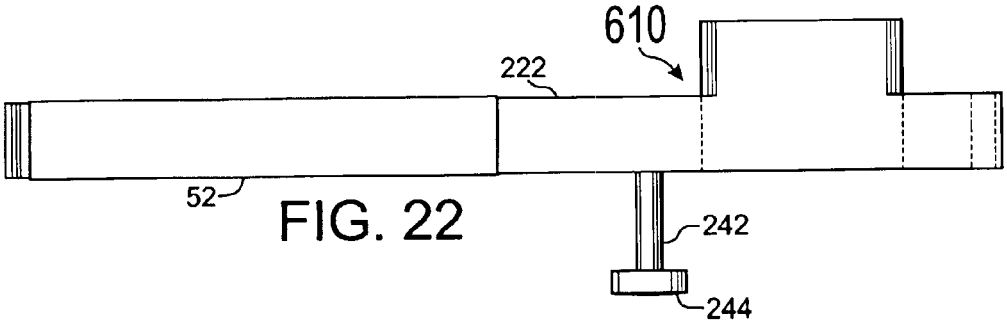
FIG. 22 is a side elevational view of the archery arrow shaft gripper and puller shown in FIG. 21.

In a sixth alternative archery arrow shaft gripper and puller 610 as shown in FIGS. 21 and 22; the puller 510 is modified by the addition of a second extending fulcrum shaft 242 (shown FIG. 22). The second extending fulcrum shaft 242 is mounted to a lower side of alternative right handle 222 near its gripping pad 48 and located along the right handle between the gripping pad and the open end of the handle. Preferably, the second extending fulcrum shaft 242 has a large fulcrum base 244 at its end away from the right handle 222 as shown in FIG. 22.

An alternative connecting mechanism not shown includes an alternative left handle having one left hinge lug with a transverse pin bore that cooperates with an alternative right handle having one right hinge lug with a transverse pin bore where the lugs overlap and the bores are coaxial and a hinge pin is inserted into the bores and secures the lugs together forming a workable hinge so that the handles may swing to and away from one another.

The surface of the fulcrum base or bases can, if desired, have a not illustrated low friction material such as polytetrafluoroethylene thereon or the base or bases can be coated or covered with a low friction material.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. An archery arrow shaft gripper and puller comprising a left handle and a right handle each having a hinged end and an open end, said hinged end of said left handle hinged by a connecting means to said hinged end of said right handle, said left handle and said right handle face each other, said left handle having a gripping pad mounted to said left handle near said hinged end of said left handle, said right handle having a gripping pad mounted to said right handle near said hinged end of said right handle, said gripping pads mounted facing each other in a cooperating relationship when said handles are swung towards one another, said connecting means comprises a left horizontal receiving slot in said hinged end of said left handle, a left vertical pin bore in said left handle intersecting said left horizontal receiving slot, a right horizontal receiving slot in said hinged end of said right handle, a right vertical pin bore in said right handle intersecting said right horizontal receiving slot, a horizontal linking bridge having a first vertical bridge bore at a first end of said bridge and a second vertical bridge bore at a second end of said bridge, said first end of said bridge is slidingly received into said left horizontal receiving slot, said first vertical bridge bore coaxially aligned with said left vertical pin bore, said bridge is retained in said left horizontal receiving slot by a fulcrum pin closely fitted and retained in said left vertical pin bore and said fulcrum pin slidingly received through said first vertical bridge bore, said second end of said bridge is slidingly received into said right horizontal receiving slot, said second vertical bridge bore coaxially aligned with said right vertical pin bore, said bridge is retained in said right horizontal receiving slot by a right retaining pin closely fitted and retained in said right vertical pin bore and said right retaining pin slidingly received through said second vertical bridge bore.

2. An archery arrow shaft gripper and puller according to claim 1 wherein said fulcrum pin having an extending fulcrum shaft extending out and down from said left vertical pin bore, and said fulcrum shaft having a fulcrum base at its end away from said left handle.

3. An archery arrow shaft gripper and puller according to claim 2 wherein said fulcrum base is coated with a low friction material.

4. An archery arrow shaft gripper and puller according to claim 3 wherein said low friction material is polytetrafluoroethylene.

5. An archery arrow shaft gripper and puller comprising a left handle and a right handle each having a hinged end and an open end, said hinged end of said left handle hinged by a connecting means to said hinged end of said right handle, said left handle and said right handle face each other, said left handle having a gripping pad mounted to said left handle near said hinged end of said left handle, said right handle having a gripping pad mounted to said right handle near said hinged end of said right handle, said gripping pads mounted facing each other in a cooperating relationship when said handles are swung towards one another, said connecting means comprises a left horizontal receiving slot in said hinged end of said left handle, a left vertical pin bore in said left handle intersecting said left horizontal receiving slot, a right horizontal receiving slot in said hinged end of said right handle, a right vertical pin bore in said right handle intersecting said right horizontal receiving slot, a horizontal linking bridge having a first vertical bridge bore at a first end of said bridge and a second vertical bridge bore at a second end of said bridge, said first end of said bridge is slidingly received into said left horizontal receiving slot, said first vertical bridge bore coaxially aligned with said left vertical pin bore, said bridge is retained in said left horizontal receiving slot by a left retaining pin closely fitted and retained in said left vertical pin bore and said left retaining pin slidingly received through said first vertical bridge bore, said second end of said bridge is slidingly received into said right horizontal receiving slot, said second vertical bridge bore coaxially aligned with said right vertical pin bore, said bridge is retained in said right horizontal receiving slot by a right retaining pin closely fitted and retained in said right vertical pin bore and said right retaining pin slidingly received through said second vertical bridge bore.

6. An archery arrow shaft gripper and puller according to claim 5 further comprising an alternative extending fulcrum shaft, said alternative extending fulcrum shaft mounted to a lower side of said left handle near its gripping pad and located along said left handle between said gripping pad and said open end of said left handle, said alternative extending fulcrum shaft having a fulcrum base at its end away from said left handle.

7. An archery arrow shaft gripper and puller according to claim 6 further comprising a second extending fulcrum shaft, said second extending fulcrum shaft mounted to a lower side of said right handle near its gripping pad and located along said right handle between said gripping pad and said open end of said right handle, said second extending fulcrum shaft having a fulcrum base at its end away from said right handle.

8. An archery arrow shaft gripper and puller comprising a left handle and a right handle each having a hinged end and an open end, said hinged end of said left handle hinged by a connecting means to said hinged end of said right handle, said left handle and said right handle face each other, said left handle having a gripping pad mounted to said left handle near said hinged end of said left handle, said right handle having a gripping pad mounted to said right handle near said hinged end of said right handle, said gripping pads mounted facing each other in a cooperating relationship when said handles are swung towards one another, said connecting means comprises said left handle having two left hinge lugs at said hinged end of said left handle, said right handle having at least one right hinge lug at said hinged end of said right handle, said left hinge lugs having a left vertical pin bore through them transverse to the longitudinal axis of said left handle and sized to receive and retain a fulcrum pin, said right hinge lug having a right vertical pin bore through it transverse to the longitudinal axis of said right handle and sized to slidingly receive through it said fulcrum pin, said right hinge lug interlaced between said left hinge lugs, said pin bores aligned coaxially, and said fulcrum pin inserted into said bores from below, said fulcrum pin having an extending fulcrum shaft extending out and down from said left vertical pin bore, said fulcrum shaft having a fulcrum base at its end away from said left handle.

9. An archery arrow shaft gripper and puller comprising a left handle and a right handle each having a hinged end and an open end, said hinged end of said left handle hinged by a connecting means to said hinged end of said right handle, said left handle and said right handle face each other, said left handle having a gripping pad mounted to said left handle near said hinged end of said left handle, said right handle having a gripping pad mounted to said right handle near said hinged end of said right handle, said gripping pads mounted facing each other in a cooperating relationship when said handles are swung towards one another, said connecting means comprises said left handle having two left hinge lugs at said hinged end of said left handle, said right handle having at least one right hinge lug at said hinged end of said right handle, said left hinge lugs having a left vertical pin bore through them transverse to the longitudinal axis of said left handle and sized to receive and retain a left retaining pin, said right hinge lug having a right vertical pin bore through it transverse to the longitudinal axis of said right handle and sized to slidingly receive through it said left retaining pin, said right hinge lug interlaced between said left hinge lugs, said pin bores aligned coaxially, and said left retaining pin inserted into said bores from below.

10. An archery arrow shaft gripper and puller according to claim 9 further comprising an alternative extending fulcrum shaft, said alternative extending fulcrum shaft mounted to a lower side of said left handle near its gripping pad and located along said left handle between said gripping pad and said open end of said left handle, said alternative extending fulcrum shaft having a fulcrum base at its end away from said left handle.

11. An archery arrow shaft gripper and puller according to claim 10 further comprising a second extending fulcrum shaft, said second extending fulcrum shaft mounted to a lower side of said right handle near its gripping pad and located along said right handle between said gripping pad and said open end of said right handle, said second extending fulcrum shaft having a fulcrum base at its end away from said right handle.

* * * * *